US011735877B2

(12) United States Patent
Chang et al.

(10) Patent No.: US 11,735,877 B2
(45) Date of Patent: Aug. 22, 2023

(54) ELECTRICAL RECEPTACLE CONNECTOR

(71) Applicant: ADVANCED-CONNECTEK INC., New Taipei (TW)

(72) Inventors: Ming-Yung Chang, New Taipei (TW); Tzu-Hao Li, New Taipei (TW); Chia-Cheng He, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 24 days.

(21) Appl. No.: 17/390,558

(22) Filed: Jul. 30, 2021

(65) Prior Publication Data

US 2022/0037843 A1 Feb. 3, 2022

(30) Foreign Application Priority Data

Jul. 31, 2020 (TW) ..... 109209944

(51) Int. Cl.

| | |
|---|---|
| ***H01R 24/60*** | (2011.01) |
| ***H01R 13/502*** | (2006.01) |
| ***H01R 43/16*** | (2006.01) |
| ***H01R 13/6581*** | (2011.01) |

(52) U.S. Cl.

CPC ..... *H01R 24/60* (2013.01); *H01R 13/502* (2013.01); *H01R 13/6581* (2013.01); *H01R 43/16* (2013.01)

(58) Field of Classification Search

CPC .. H01R 24/60; H01R 13/502; H01R 13/6581; H01R 43/16

USPC ..... 439/660

See application file for complete search history.

(56) References Cited

U.S. PATENT DOCUMENTS

| | | | | |
|---|---|---|---|---|
| 6,168,467 | B1 * | 1/2001 | Chiou | H01R 13/6582 439/607.01 |
| 6,224,422 | B1 * | 5/2001 | Zhu | H01R 23/6873 439/607.01 |
| 7,410,390 | B2 * | 8/2008 | Watanabe | H01R 13/6594 439/607.01 |
| 9,391,410 | B2 * | 7/2016 | Yu | H01R 13/6594 |
| 9,490,579 | B2 * | 11/2016 | Little | H01R 13/642 |
| 9,496,653 | B2 * | 11/2016 | Little | H01R 13/6582 |
| 9,647,369 | B2 * | 5/2017 | Tsai | H01R 24/62 |
| 9,728,900 | B1 * | 8/2017 | Tsai | H01R 24/60 |
| 9,847,595 | B2 * | 12/2017 | Tsai | H01R 13/6581 |
| 9,865,962 | B2 * | 1/2018 | Zhao | H01R 13/6585 |
| 9,865,974 | B2 * | 1/2018 | Chen | H01R 13/6585 |

(Continued)

*Primary Examiner* — Peter G Leigh

(74) *Attorney, Agent, or Firm* — Muncy, Geissler, Olds & Lowe, P.C.

(57) ABSTRACT

An electrical receptacle connector is enclosed by an outer shell. The outer shell includes a rear covering plate, side plates, and top plates. Two turned portions are at two sides of the rear covering plate. The side plates outwardly extend from the turned portions, respectively. Each of the top plates is bent from a top portion of the corresponding side plate and extends away from the corresponding side plate. The rear covering plate and the side plates are integrally formed as a one-piece member. Hence, the steps of manufacturing process for the connector can be reduced, the production of defective products can be reduced, and the structural strength of the connector can be improved. Moreover, numbers of holes or cracks between the rear covering plate and each of the side plates can be reduced, thereby reducing the EMI issue.

17 Claims, 6 Drawing Sheets

(56) References Cited

U.S. PATENT DOCUMENTS

| | | | | |
|---|---|---|---|---|
| 9,935,401 | B2 * | 4/2018 | Tsai | H01R 13/6586 |
| 9,948,041 | B2 * | 4/2018 | Chen | H01R 13/6585 |
| 9,979,134 | B2 * | 5/2018 | Yu | H01R 13/6585 |
| 10,027,069 | B2 * | 7/2018 | Huang | H01R 13/504 |
| 10,116,101 | B2 * | 10/2018 | Huang | H01R 13/6683 |
| 10,490,940 | B2 * | 11/2019 | Ju | H01R 13/6594 |
| 2004/0180577 | A1 * | 9/2004 | Zhang | H01R 13/6594 439/607.04 |
| 2007/0105440 | A1 * | 5/2007 | Delaney | H01R 12/707 439/607.36 |
| 2014/0073190 | A1 * | 3/2014 | Zhao | H01R 13/6594 29/883 |
| 2015/0162714 | A1 * | 6/2015 | Yu | H01R 24/62 439/660 |
| 2016/0240980 | A1 * | 8/2016 | Yu | H01R 12/724 |
| 2018/0076582 | A1 * | 3/2018 | Chen | H01R 13/6594 |

* cited by examiner

ELECTRICAL RECEPTACLE CONNECTOR

CROSS-REFERENCE TO RELATED APPLICATION

This non-provisional application claims priority under 35 U.S.C. § 119(a) to Patent Application No. 109209944 filed in Taiwan, R.O.C. on Jul. 31, 2020, the entire contents of which are hereby incorporated by reference.

FIELD OF THE INVENTION

The instant disclosure relates to an electrical connector, and more particular to an electrical receptacle connector.

BACKGROUND

Currently, the increase in the functionality of various electronic devices is driving the demand for smaller and smaller devices that are easier and more convenient for users to carry and use. This causes many electrical/electronic components within the device to be located closer together. This increases the possibility that the various electronic components in the device will suffer from electromagnetic interference (EMI) or radio frequency interference (RFI) either from RF components such as the antenna, microphone components, RF power amplifiers, etc. and subsystems in the device and/or from external sources. The high speed signal transmission in these devices can produce electromagnetic emissions, which may leak from the connection between the plug connector and its mating connector. These emissions can cause problems in high speed signal transmissions in that they can negatively influence wireless communication between two devices.

There are various transmission interfaces for the connectors; for example, HDMI transmission interface and Universal Serial Bus (USB) interface. Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

SUMMARY OF THE INVENTION

Regarding an electrical connector known to the inventor(s), an outer shell encloses the metallic shell of the electrical connector, and the rear portion of the outer shell has a metallic covering plate bending downwardly to cover the rear portion of the base member (the terminal base) in the metallic shell so as to prevent from signal interferences. Two sides of the metallic covering plate has hanging portions, and the hanging portions are engaged with protruding blocks of side walls at two sides of the outer shell. During the manufacturing process of the connector, the metallic shell has to be covered on the rear portion of the terminal base, and during this additional manufacturing procedure, the engagements between the hanging portions and the protruding blocks may be improper, thus causing defective products.

In view of this, an embodiment of the instant disclosure provides an electrical receptacle connector. The electrical receptacle connector comprises a metallic shell, an insulated housing, a plurality of terminals, and an outer shell. The insulated housing is in the metallic shell. The insulated housing comprises a base portion and a tongue portion outwardly extending from one side of the base portion. Each of the terminals comprises a flat contact portion and a tail portion. Each of the flat contact portions is held in a surface of the tongue portion, and each of the tail portions protrudes out of the base portion. The outer shell enclosing the metallic shell. The outer shell comprises a rear covering plate, a plurality of side plates, and a plurality of top plates. Two turned portions are at two sides of the rear covering plate. The side plates outwardly extend in a same direction from the turned portions at the two sides of the rear covering plate, respectively. The side plates and the rear covering plate are integrally formed as a one-piece member. Each of the top plates is bent from a top portion of the corresponding side plate and extends away from the corresponding side plate. The top plates are on a top surface of the metallic shell.

In one or some embodiments, a top portion of the rear covering plate is bent to form a shielding plate, and an end portion of the shielding plate extends toward a side portion of each of the top plates and is adjacent to the side portion of each of the top plates.

In one or some embodiments, a gap is between the shielding plate and the side portion of each of the top plates.

In one or some embodiments, a bent portion is formed on the top portion of the rear covering plate, and the shielding plate extends from the bent portion.

In one or some embodiments, a bottom portion of a front portion of each of the side plates is bent to form a holding plate, and the holding plates extend toward each other.

In one or some embodiments, a plurality of soldering contacts is formed on an upper surface of each of the top plates.

In one or some embodiments, end portions of the top plates are adjacent to each other, and a space having an opening is formed between the end portions of the top plates.

In one or some embodiments, end portions of the top plates are in contact with each other, and the end portions of the top plates form a closed surface.

In one or some embodiments, the outer shell is a one-piece member, and an opening is formed on one side of the outer shell.

In one or some embodiments, each of the side plates comprises a hook portion and a recessed hole.

According to one or some embodiments of the instant disclosure, the rear covering plate and the side plates at two sides of the rear covering plate are integrally formed as a one-piece member, and the side plates respectively extend from the two sides of the rear covering plate in a same direction. Hence, the steps of manufacturing process for the connector can be reduced, the production of defective products can be reduced, the structural strength of the connector can be improved, and the width of the entire outer shell can be reduced. Moreover, numbers of holes or cracks between the rear covering plate and each of the side plates at the two sides of the rear covering plate can be reduced, thereby relatively reducing the EMI issue.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
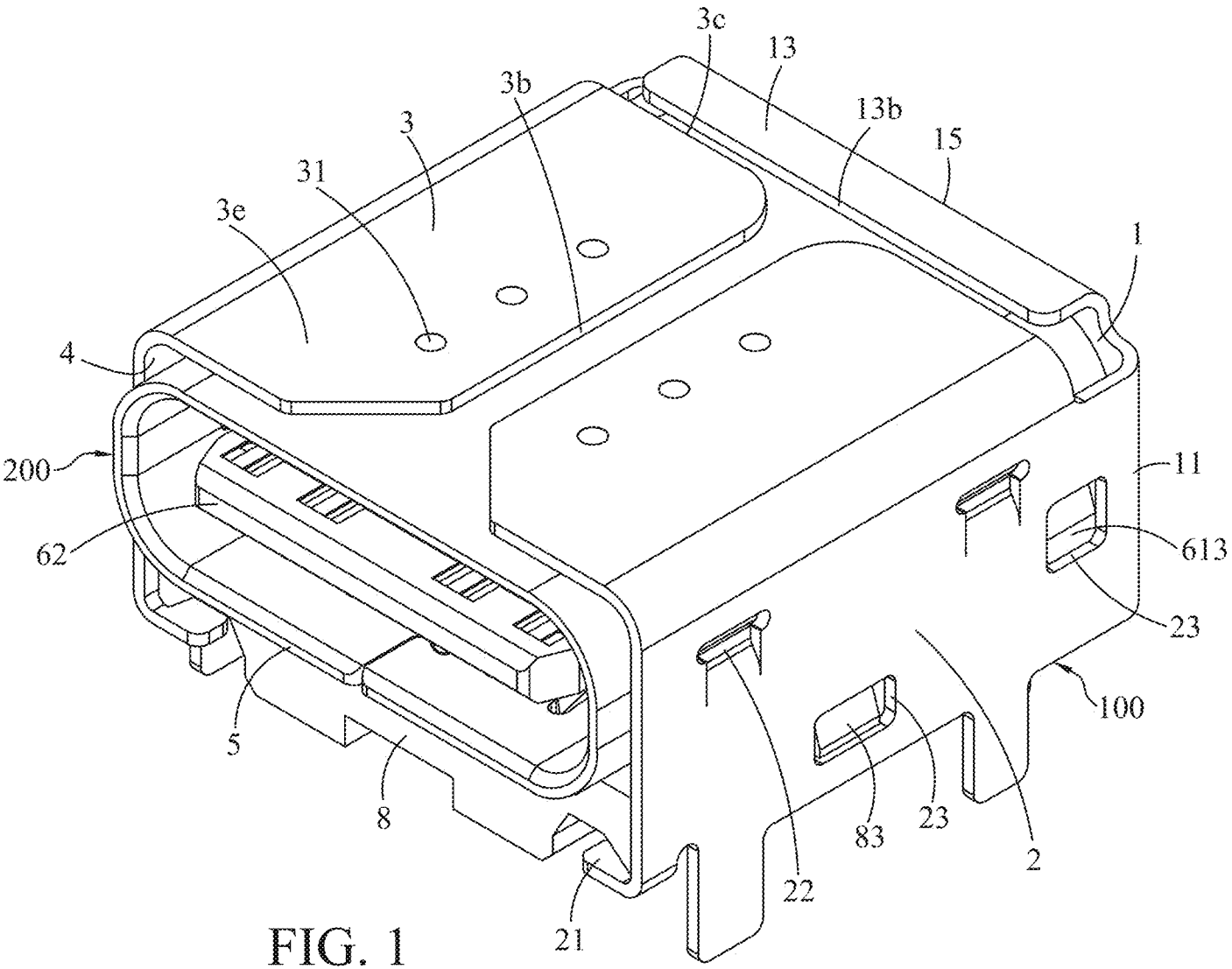
FIG. 1 illustrates a front perspective view of an electrical receptacle connector of an exemplary embodiment of the instant disclosure.
Figure 2:
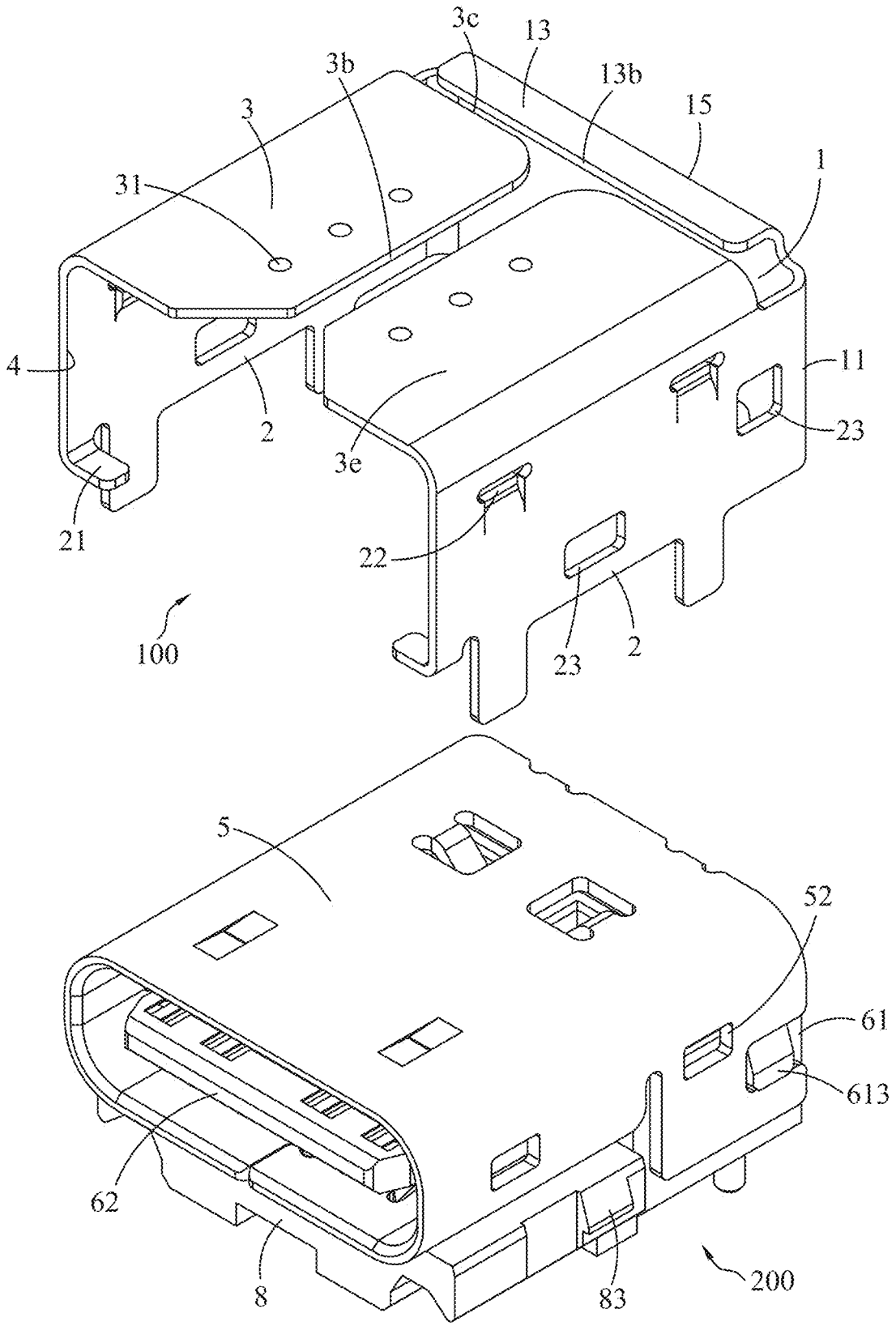
FIG. 2 illustrates an exploded view of the electrical receptacle connector of the exemplary embodiment.
Figure 3:
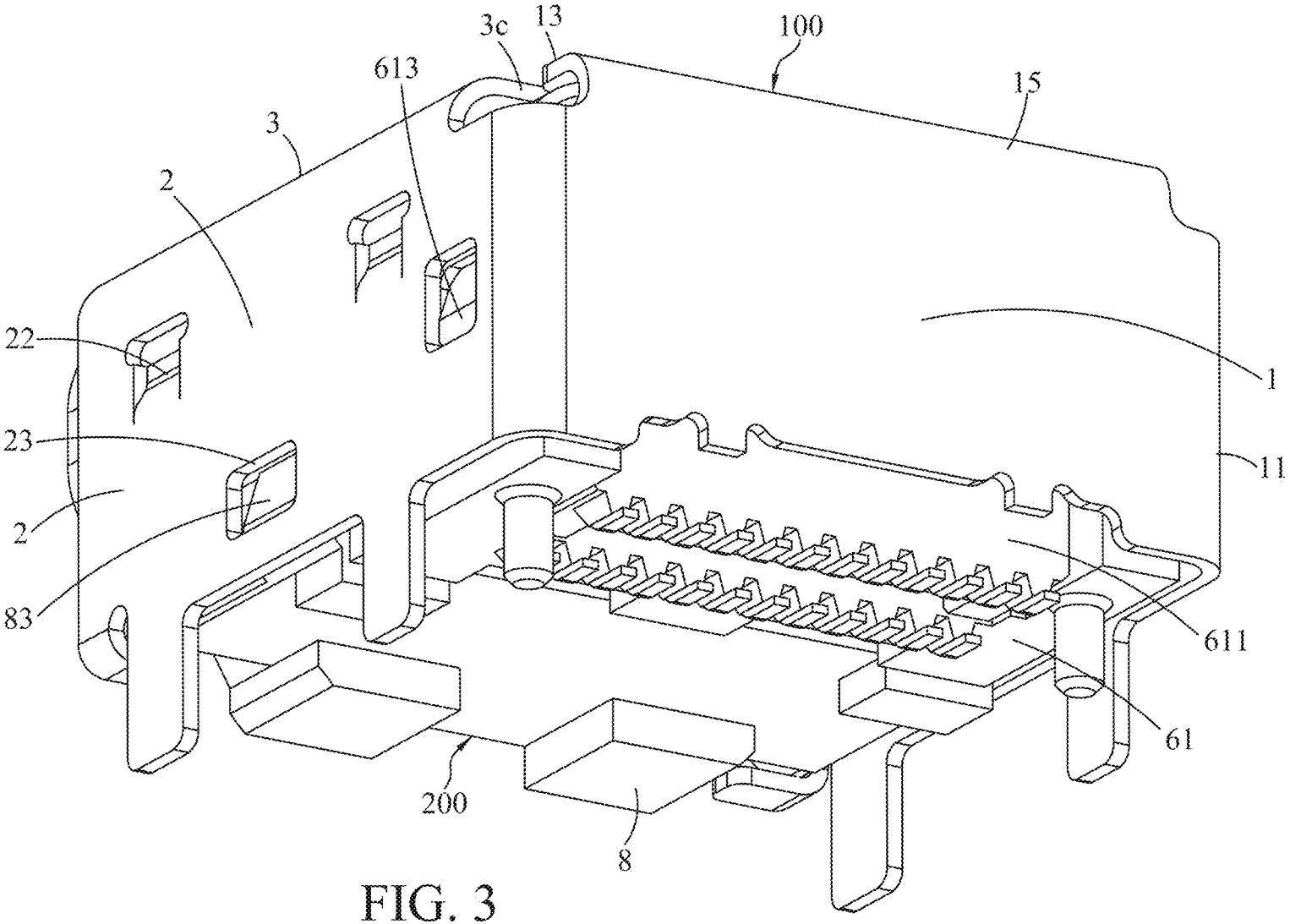
FIG. 3 illustrates a rear perspective view of the electrical receptacle connector of the exemplary embodiment.

Please refer to FIGS. 1 and 3, illustrating an electrical receptacle connector 200 according to an exemplary embodiment of the instant disclosure. FIG. 1 illustrates a front perspective view of the electrical receptacle connector 200 of the exemplary embodiment. FIG. 2 illustrates an exploded view of the electrical receptacle connector 200 of the exemplary embodiment. FIG. 3 illustrates a rear perspective view of the electrical receptacle connector 200 of the exemplary embodiment. In this embodiment, the electrical receptacle connector 200 is in accordance with the specification of USB 3.0 or USB 3.1 (type-C) connection interfaces, but embodiments are not limited thereto; the electrical receptacle connector 200 may be in accordance with the specification of USB 2.0 or HDMI connection interfaces.

Figure 4:
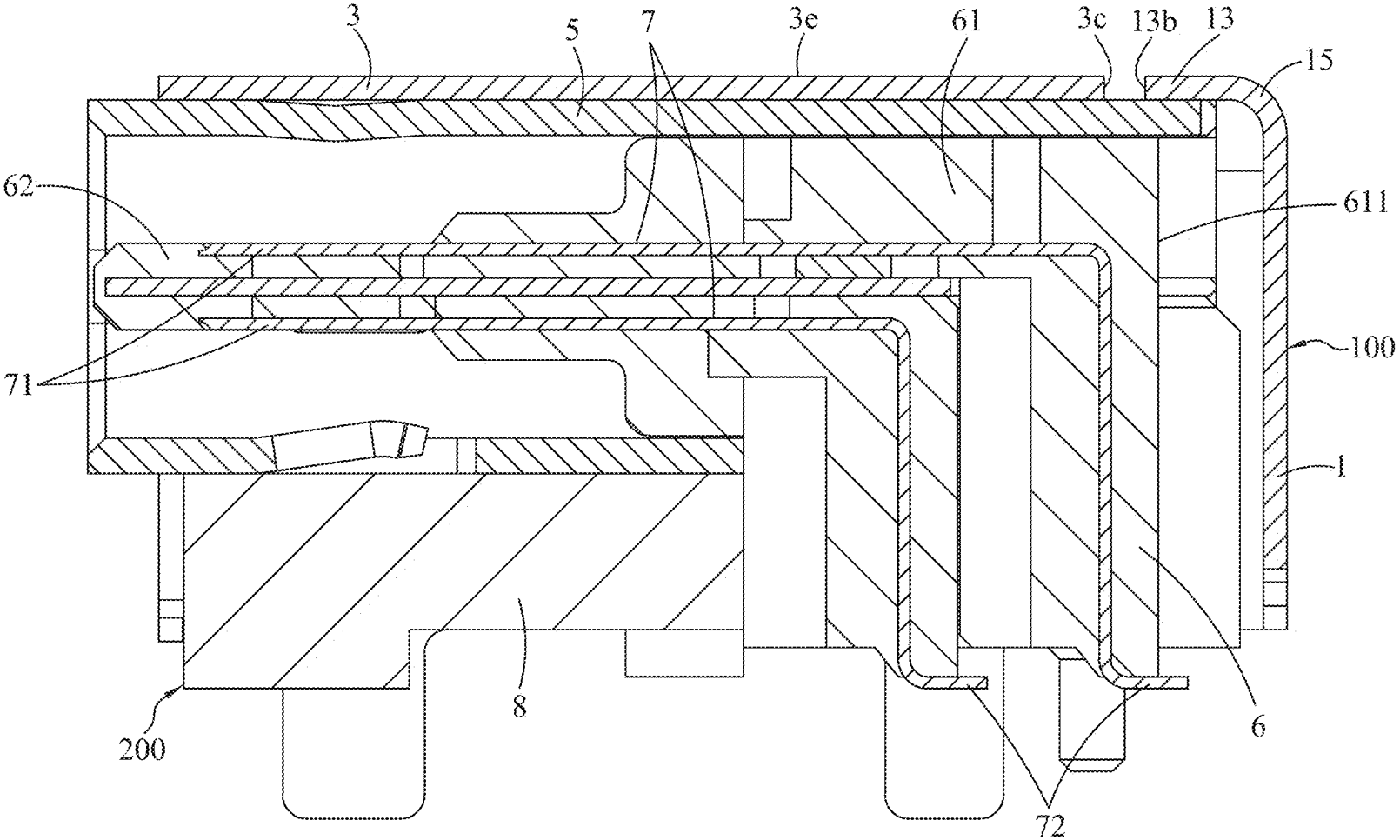
FIG. 4 illustrates a cross-sectional view of the electrical receptacle connector of the exemplary embodiment.
Figure 5:
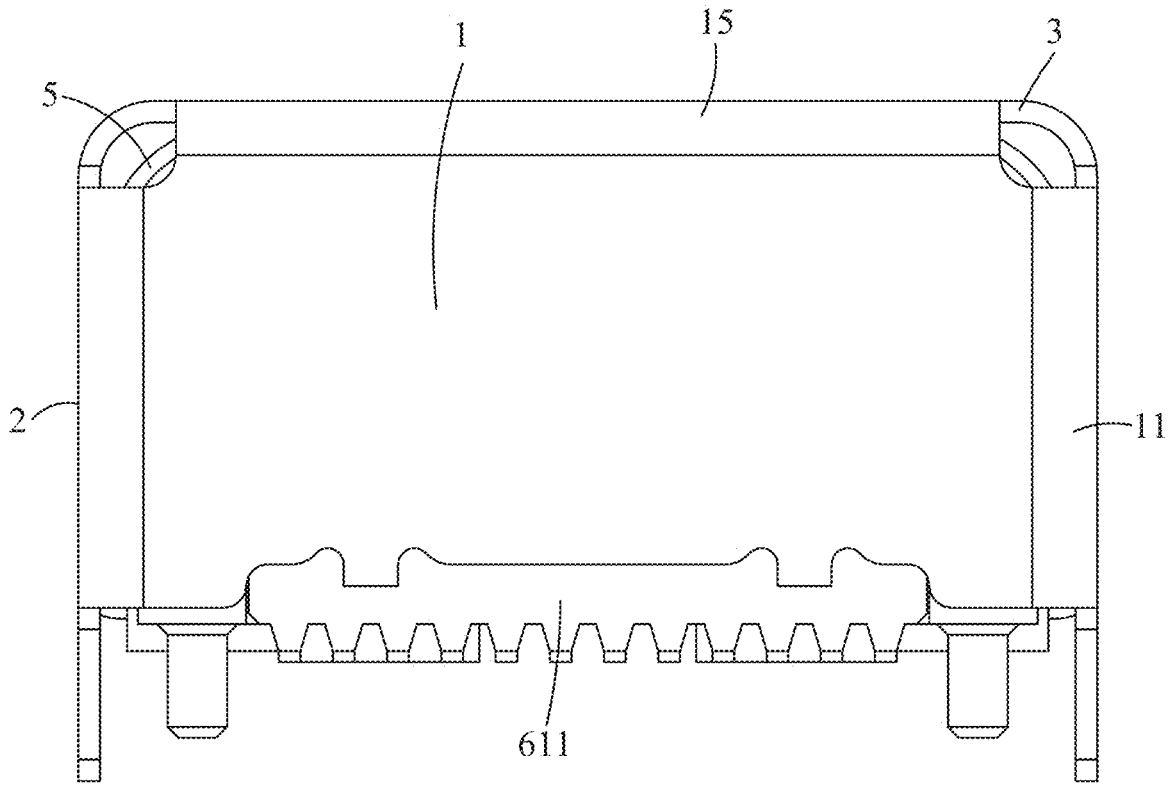
FIG. 5 illustrates a rear view of the electrical receptacle connector of the exemplary embodiment.

Please refer to FIGS. 1 to 5. FIG. 4 illustrates a cross-sectional view of the electrical receptacle connector 200 of the exemplary embodiment. FIG. 5 illustrates a rear view of the electrical receptacle connector 200 of the exemplary embodiment. In this embodiment, the electrical receptacle connector 200 comprises a metallic shell 5, an insulated housing 6, and a plurality of terminals 7. The insulated housing 6 is in the metallic shell 5. The insulated housing 6 comprises a base portion 61 and a tongue portion 62 outwardly extending from one of two sides of the base portion 61. A rear side surface 611 is at the other side of the base portion 61, and the rear side surface 611 is exposed out of the metallic shell 5. Each of the terminals 7 comprises a flat contact portion 71 and a tail portion 72. Each of the flat contact portions 71 is held in a surface of the tongue portion 62, and each of the tail portions 72 protrudes out of the base portion 61.

In this embodiment, the outer shell 100 encloses the metallic shell 5 of the electrical receptacle connector 200. The outer shell 100 comprises a rear covering plate 1, a plurality of side plates 2, and a plurality of top plates 3. The rear covering plate 1 covers the rear side surface 611 of the base portion 61. The side plates 2 respectively cover two sides of the electrical receptacle connector 200. The top plates 3 respectively cover the top of the electrical receptacle connector 200. Front portions of the side plates 2 and front portions of the top plates 3 are enclosed to form an opening 4 in rectangular shaped. That is, in this embodiment, the opening 4 is formed on one of two opposite sides of the outer shell 100, and the other side of the outer shell 100 is the rear covering plate 1. It is understood that, regarding the electrical receptacle connector known to the inventor(s), the outer shell and the metallic covering plate are in a two piece configuration, and the two pieces are combined with each other through buckling. On the other hand, in this embodiment, the outer shell 100 is a one-piece member, and the outer shell 100 is formed by bending and processing a plate member.

In this embodiment, two turned portions 11 are at two sides of the rear covering plate 1. The side plates 2 outwardly extend in the front direction from the turned portions 11 at the two sides of the rear covering plate 1, respectively. Moreover, the side plates 2 and the rear covering plate 1 are integrally formed as a one-piece member. In manufacturing the outer shell 100, a flat extended plate member is bent and processed, so that a portion of the plate member corresponding to the rear covering plate 1 (the rear covering plate 1) is configured to stand. Next, portions of the plate member corresponding to the side plates 2 (the side plates 2) are bent from two sides of the rear covering plate 1, so that the side plates 2 are arranged at front sides of the two sides of the rear covering plate 1. Therefore, from a top view of the outer shell 100, the rear covering plate 1 and the side plates 2 are formed as a reversed U-shape structure. It should be noted that, in the manufacturing process for the outer shell of the electrical receptacle connector known to the inventor(s), the side plates and the top plates are bent and fixed in advance, and then the metallic covering plate is bent downwardly from a rear portion of the top plate of the outer shell. On the other hand, the manufacturing process for the outer shell 100 according to one or some embodiments of the instant disclosure is different from that of the outer shell of the electrical receptacle connector known to the inventor(s).

Figure 6:
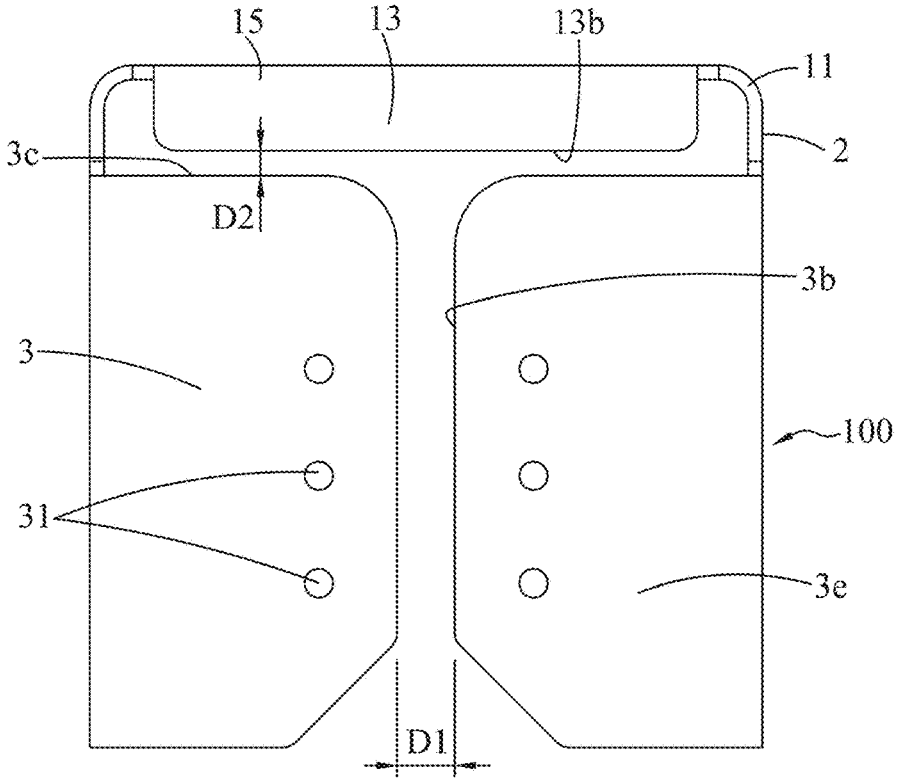
FIG. 6 illustrates a top view of the electrical receptacle connector of the exemplary embodiment.

Please refer to FIGS. 2 to 6. FIG. 6 illustrates a top view of the electrical receptacle connector 200 of the exemplary embodiment. In this embodiment, each of the top plates 3 is bent from a top portion of the corresponding side plate 2. The top plates 3 are arranged horizontally. The top plates 3 extend toward each other and are on a top surface of the metallic shell 5. From a front view of the outer shell 100, each of the top plates 3 and the corresponding side plate 2 are formed as a reversed L-shape structure. In this embodiment, end portions 3*b* of the top plates 3 are adjacent to each other, and a space D1 is formed between the end portions 3*b* of the top plates 3. Regarding the outer shell known to the inventor(s), the top plate is a plate member integrally formed with the side plates. On the other hand, in this embodiment, the top plates 3 are two piece structures, the left top plate 3 and the left side plate 2 are integrally formed as a one-piece member, and the right top plate 3 and the right side plate 2 are integrally formed as a one-piece member.

Figure 7:
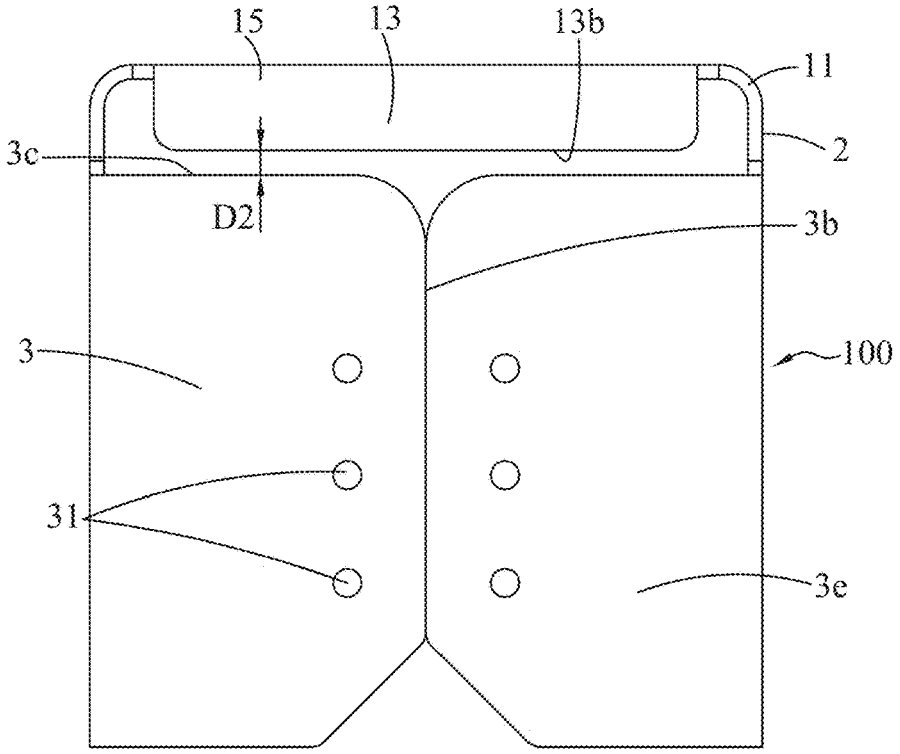
FIG. 7 illustrates a top view of an electrical receptacle connector according to another exemplary embodiment of the instant disclosure.

In this embodiment, more specifically, the top plates 3 are arranged symmetrically. The sizes of the top plates 3 may be the same, but embodiments are not limited thereto. In some embodiments, the sizes of the top plates 3 may be different; the top plate 3 at one of two sides of the outer shell 100 may have a larger size, while the top plate 3 at the other side of the outer shell 100 may have a smaller size. The top plates 3 cover the outer surface of the metallic shell 100 of the electrical receptacle connector 200. The electromagnetic interference (EMI) issue encountered by the electrical receptacle connector 200 may be reduced by the shielding of the metallic shell 5. Moreover, as shown in FIG. 7, in some embodiments, the end portions 3*b* of the top plates 3 may be in contact with each other, and the end portions 3*b* of the top plates 3 form a closed surface.

In this embodiment, more specifically, during the electrical receptacle connector 200 performs signal transmission, noise signals caused by the EMI (e.g., high frequency signal interferences which will affect the high frequency characteristics of the connector) can be shielded by the rear covering plate 1. Accordingly, EMI and RFI issues can be properly reduced, thereby improving the high frequency shielding effect and helpful in high-frequency signal transmission.

Please refer to FIGS. 2 to 5. In this embodiment, more specifically, the rear covering plate 1 is a standing plate, and a top portion of the rear covering plate 1 is bent to form a shielding plate 13. An end portion 13*b* of the shielding plate 13 extends toward a side portion 3*c* of each of the top plates 3, and the end portion 13*b* of the shielding plate 13 is adjacent to the side portion 3*c* of each of the top plates 3. In this embodiment, the shielding plate 13 and the rear covering plate 1 cover an upper surface of the rear portion of the metallic shell 5 and the rear side surface 611 of the base portion 61 of the electrical receptacle connector 200. Hence, the limiting at the rear portion and at the top portion of the electrical receptacle connector 200 can be improved. Moreover, since the rear side surface 611 of the base portion 61 is exposed form the rear portion of the metallic shell 1, the rear side surface 611 of the base portion 61 can be covered and shielded by the rear covering plate 1, thereby preventing from emissions of EMI noise.

Please refer to FIGS. 2 to 6. In this embodiment, more specifically, a gap D2 is between the end portion 13*b* of the shielding plate 13 and the side portion 3*c* of each of the top plates 3. Moreover, a bent portion 15 is formed on the top portion of the rear covering plate 1, and the shielding plate 13 extends and is bent from the bent portion 15. The shielding plate 13 extends laterally and is adjacent to the side portion 3*c* of each of the top plates 3.

Please refer to FIGS. 2 to 5. In this embodiment, more specifically, the bent portion 15 and the shielding plate 13 are integrally formed as a one-piece member. The structure formed by the bent portion 15 and the shielding plate 13 is flat and does not have any cracks. Hence, holes or cracks are not formed on the structure to cause EMI problems. On the other hand, regarding the electrical connector known to the inventor(s), the bent portion of the metallic covering plate forms holes, so that the metallic covering plate can be bent downwardly from the rear portion of the top plate. That is, regarding the electrical connector known to the inventor(s), since the bent portion is a plate structure and cannot be bent downwardly easily, the plate structure are hollowed to form several holes, so that the metallic covering plate can be bent to cover the rear portion of the base portion.

Please refer to FIGS. 2 to 5. In this embodiment, more specifically, when the outer shell 100 is assembled on the electrical receptacle connector 200, the rear covering plate 1 can be covered on the rear portion of the base portion 61 without being bent. It is understood that, in this embodiment, the rear covering plate 1 is not bent downwardly from the rear portions of the top plates 3; conversely, the side plates 2 are bent forwardly from the two sides of the rear covering plate 1. Hence, in this embodiment holes are not necessarily needed to be formed on the bent portion 15 or to be formed on the side plates 2. Accordingly, numbers of holes or cracks between the rear covering plate 1 and each of the side plates 2 at the two sides of the rear covering plate 1 can be reduced, thereby relatively reducing the EMI issue. On the other hand, regarding the electrical connector known to the inventor(s), the side plates and the metallic covering plate are separated pieces before being assembled with each other. Therefore, after the side plates and the metallic covering plate are assembled with each other, holes, cracks, or slits are formed between each of the side plates and the metallic covering plate, thereby causing the EMI issues due to the emission of electromagnetic radiations.

Please refer to FIGS. 1 to 5. In this embodiment, more specifically, a bottom portion of a front portion of each of the side plates 2 is bent to form a holding plate 21, and the holding plates 21 extend toward each other. The holding plates 21 are respectively held on two sides of a supporting block 8 at a bottom portion of the electrical receptacle connector 200. In this embodiment, the electrical receptacle connector 200 is to be assembled on an upper surface of a circuit board (namely, an on-board connector). The supporting block 8 is positioned at the bottom portion of the electrical receptacle connector 200 for lifting up the electrical receptacle connector 200, but embodiments are not limited thereto. In some embodiments, the electrical receptacle connector 200 may be a sinking type connector.

Please refer to FIGS. 1 to 5. In this embodiment, more specifically, a plurality of soldering contacts 31 is formed on an upper surface 3*e* of each of the top plates 3 by processing the upper surface 3*e* of each of the top plates 3. In this embodiment, laser is applied to process the upper surface 3*e* of each of the top plates 3, so that the soldering contacts 31 are formed on the top plates 3 for connecting to the metallic shell 5 of the electrical receptacle connector 200, thereby enhancing the fixation between the top plates 3 and the metallic shell 5.

Please refer to FIGS. 1 to 5. In this embodiment, more specifically, the outer shell 100 is assembled out of the electrical receptacle connector 200 in a top-to-bottom direction, and the rear covering plate 1 covers the rear surface of the electrical receptacle connector 200, thereby preventing the interference signals from being emitted from the rear portion of the base portion 61 to cause EMI issues. In this embodiment, each of the side plates 2 of the outer shell 100 comprises a hook portion 22, and the hook portions 22 are buckled with the buckling holes 52 on the metallic shell 5 of the electrical receptacle connector 200. Moreover, each of the side plates 2 of the outer shell 100 comprises a plurality of recessed holes 23, the protruding blocks 83 of the supporting block 8 of the electrical receptacle connector 200 are buckled with some of the recessed holes 23, and the protruding blocks 83 at two sides of the base portion 61 of the electrical receptacle connector 200 are buckled with rest of the recessed holes 23.

Please refer to FIGS. 1 to 5. In this embodiment, specifically, the rear covering plate 1 and the side plates 2 are integrally formed as a one-piece member. Hence, the structural strength of the outer shell 100 can be improved. And two sides of each of the side plates 2 form flat surfaces. Regarding the electrical connector known to the inventor(s), the surfaces of two sides of each of the side plates have engaging blocks. When the metallic covering plate is bent, the hanging portions are respectively engaged with the engaging blocks. Since the hanging portions and the engaging blocks are located at two sides of each of the side plates, the overall width of the outer shell increases thereby the outer shell occupying a larger space. On the other hand, in one or some embodiments of the instant disclosure, engaging blocks are not provided at the two sides of each of the side plates 2, and hanging portions are not provided at the two sides of the rear covering plate 1, so that the outer surface of each of the side plates 2 does not have a protruding structure formed by the hanging portion and the engaging block. That is, in this embodiment, the outer surface of each of the side plats 2 is a flat surface, thereby relatively reducing the overall width of the outer shell 100 and the outer shell 100 not occupying a larger space.

According to one or some embodiments of the instant disclosure, the rear covering plate and the side plates at two sides of the rear covering plate are integrally formed as a one-piece member, and the side plates respectively extend from the two sides of the rear covering plate in a same direction. Hence, the steps of manufacturing process for the connector can be reduced, the production of defective products can be reduced, the structural strength of the connector can be improved, and the width of the entire outer shell can be reduced. Moreover, numbers of holes or cracks between the rear covering plate and each of the side plates at the two sides of the rear covering plate can be reduced, thereby relatively reducing the EMI issue.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell;

an insulated housing in the metallic shell, wherein the insulated housing comprises a base portion and a tongue portion outwardly extending from one side of the base portion;

a plurality of terminals, wherein each of the terminals comprises a flat contact portion and a tail portion, each of the flat contact portions is held in a surface of the tongue portion, and each of the tail portions protrudes out of the base portion; and an outer shell enclosing the metallic shell, wherein the outer shell comprises a rear covering plate, a plurality of side plates, and a plurality of top plates, two turned portions are at two sides of the rear covering plate, the side plates outwardly extend in a same direction from the turned portions at the two sides of the rear covering plate, respectively, the side plates and the rear covering plate are integrally formed as a one-piece member, each of the top plates is bent from a top portion of the corresponding side plate and extends away from the corresponding side plate, and the top plates are on a top surface of the metallic shell.

2. The electrical receptacle connector according to claim 1, wherein a top portion of the rear covering plate is bent to form a shielding plate, and an end portion of the shielding plate extends toward a side portion of each of the top plates and is adjacent to the side portion of each of the top plates.

3. The electrical receptacle connector according to claim 2, wherein a gap is between the shielding plate and the side portion of each of the top plates.

4. The electrical receptacle connector according to claim 2, wherein a bent portion is formed on the top portion of the rear covering plate, and the shielding plate extends from the bent portion.

5. The electrical receptacle connector according to claim 1 wherein a bottom portion of a front portion of each of the side plates is bent to form a holding plate, and the holding plates extend toward each other.

6. The electrical receptacle connector according to claim 1, wherein a plurality of soldering contacts is formed on an upper surface of each of the top plates.

7. The electrical receptacle connector according to claim 1, wherein end portions of the top plates are in contact with each other, and the end portions of the top plates form a closed surface.

8. The electrical receptacle connector according to claim 1, wherein the outer shell is a one-piece member, and an opening is formed on one side of the outer shell.

9. The electrical receptacle connector according to claim 1, wherein each of the side plates comprises a hook portion and a recessed hole.

10. An electrical receptacle connector, comprising:

a metallic shell;

an insulated housing in the metallic shell, wherein the insulated housing comprises a base portion and a tongue portion outwardly extending from one side of the base portion;

a plurality of terminals, wherein each of the terminals comprises a flat contact portion and a tail portion, each of the flat contact portions is held in a surface of the tongue portion, and each of the tail portions protrudes out of the base portion; and an outer shell enclosing the metallic shell, wherein the outer shell comprises a rear covering plate, a plurality of side plates, and a plurality of top plates, two turned portions are at two sides of the rear covering plate, the side plates outwardly extend in a same direction from the turned portions at the two sides of the rear covering plate, respectively, the side plates and the rear covering plate are integrally formed as a one-piece member, each of the top plates is bent from a top portion of the corresponding side plate and extends away from the corresponding side plate, and the top plates are on a top surface of the metallic shell, wherein end portions of the top plates are adjacent to each other, and a space having an opening is formed between the end portions of the top plates.

11. The electrical receptacle connector according to claim 10, wherein a top portion of the rear covering plate is bent to form a shielding plate, and an end portion of the shielding plate extends toward a side portion of each of the top plates and is adjacent to the side portion of each of the top plates.

12. The electrical receptacle connector according to claim 11, wherein a gap is between the shielding plate and the side portion of each of the top plates.

13. The electrical receptacle connector according to claim 11, wherein a bent portion is formed on the top portion of the rear covering plate, and the shielding plate extends from the bent portion.

14. The electrical receptacle connector according to claim 10, wherein a bottom portion of a front portion of each of the side plates is bent to form a holding plate, and the holding plates extend toward each other.

15. The electrical receptacle connector according to claim 10, wherein a plurality of soldering contacts is formed on an upper surface of each of the top plates.

16. The electrical receptacle connector according to claim 10, wherein the outer shell is a one-piece member, and an opening is formed on one side of the outer shell.

17. The electrical receptacle connector according to claim 10, wherein each of the side plates comprises a hook portion and a recessed hole.

* * * * *